US007936327B2

(12) United States Patent
Yu et al.

(10) Patent No.: US 7,936,327 B2
(45) Date of Patent: May 3, 2011

(54) DRIVING CIRCUIT HAVING COMPENSATIVE UNIT FOR PROVIDING COMPENSATIVE VOLTAGES TO DATA DRIVING CIRCUITS BASED ON VOLTAGES OF TWO NODES OF GATE LINE, METHOD FOR MAKING SAME, AND LIQUID CRYSTAL PANEL WITH SAME

(75) Inventors: Guo-Hua Yu, Shenzhen (CN); Yu-Hsun Jen, Miao-Li (TW)

(73) Assignees: Innocom Technology (Shenzhen) Co., Ltd., Shenzhen, Guangdong Province (CN); Chimei Innolux Corporation, Miao-Li County (TW)

( * ) Notice: Subject to any disclaimer, the term of this patent is extended or adjusted under 35 U.S.C. 154(b) by 840 days.

(21) Appl. No.: 11/906,465

(22) Filed: Oct. 1, 2007

(65) Prior Publication Data

US 2008/0088563 A1 Apr. 17, 2008

(30) Foreign Application Priority Data

Sep. 29, 2006 (TW) ..... 95136308 A

(51) Int. Cl.
*G09G 3/36* (2006.01)

(52) U.S. Cl. ..... 345/94

(58) Field of Classification Search ..... 345/87–101, 345/104, 210–212

See application file for complete search history.

(56) References Cited

U.S. PATENT DOCUMENTS

| | | | | |
|---|---|---|---|---|
| 5,457,474 | A * | 10/1995 | Ikeda | 345/92 |
| 5,841,415 | A * | 11/1998 | Kwon et al. | 345/90 |
| 6,771,243 | B2 | 8/2004 | Hirohata | |
| 7,133,034 | B2 | 11/2006 | Park et al. | |
| 2001/0022570 | A1 * | 9/2001 | Chang et al. | 345/98 |
| 2002/0196246 | A1 * | 12/2002 | Kanzaki et al. | 345/208 |
| 2003/0098833 | A1 * | 5/2003 | Sekido et al. | 345/87 |
| 2006/0071890 | A1 | 4/2006 | Kikuchi | |
| 2007/0080914 | A1 * | 4/2007 | Sun et al. | 345/88 |

FOREIGN PATENT DOCUMENTS

TW I240236 B 9/2005

* cited by examiner

*Primary Examiner* — Chanh Nguyen
*Assistant Examiner* — Sanghyuk Park
(74) *Attorney, Agent, or Firm* — Wei Te Chung

(57) ABSTRACT

An exemplary driving circuit (20) includes: gate lines (201); data lines orthogonal to the gate lines (202); thin film transistors (203); gate driving circuits (210) for driving the gate lines; data driving circuits (220) for driving the data lines; and a compensative unit (230) having a first input terminal (235), a second input terminal (236), and output terminals (238) coupled to the data driving circuits. The first and second input terminals are coupled to two nodes (a, b) of one of the gate line, and the two nodes are coupled to two gate electrodes of two thin film transistors respectively connected to two data driving circuits. The compensative unit outputs compensative voltages for compensating data voltage signals outputted by the data driving circuits.

11 Claims, 7 Drawing Sheets

DRIVING CIRCUIT HAVING COMPENSATIVE UNIT FOR PROVIDING COMPENSATIVE VOLTAGES TO DATA DRIVING CIRCUITS BASED ON VOLTAGES OF TWO NODES OF GATE LINE, METHOD FOR MAKING SAME, AND LIQUID CRYSTAL PANEL WITH SAME

FIELD OF THE INVENTION

The present invention relates to driving circuits typically used for liquid crystal display (LCD) panels, and more particularly to a driving circuit with a compensative unit. The compensative unit is capable of compensating signal voltages output from a data driving circuit of an LCD panel according to scanning signals.

BACKGROUND

Because LCD devices have the advantages of portability, low power consumption, and low radiation, they have been widely used in various portable information products such as notebooks, personal digital assistants (PDAs), video cameras, and the like. Furthermore, LCD devices are considered by many to have the potential to completely replace CRT (cathode ray tube) monitors and televisions.

FIG. 7 is an abbreviated diagram of a typical driving circuit for an LCD panel. The driving circuit 10 includes a plurality of parallel gate lines 101, a plurality of parallel data lines 102 orthogonal to and isolated from the gate lines 101, a plurality of thin film transistors 103 positioned near crossings of corresponding gate lines 101 and corresponding data lines 102, a plurality of gate driving circuits 110 for driving the gate lines 101, and a plurality of data driving circuits 120 for driving the data lines 102.

Also referring to FIG. 8, two adjacent gate lines 101 (Gn, Gn-1) and two adjacent data lines 102 (Dm-1, Dm) cooperatively define a pixel region (not labeled). In each pixel region, the driving circuit 10 further includes a pixel electrode 104 and a common electrode 105. The pixel electrode 104 and the common electrode 105 cooperatively form a storage capacitor 106. The thin film transistor 103 includes a gate electrode 1031 connected to a corresponding gate line Gn-1, a source electrode 1032 connected to a corresponding data line Dm-1, and a drain electrode 1033 connected to the pixel electrode 104.

Due to the resistance R of the gate lines 101 and the parasitic capacitance $C_{gd}$ generated between the gate electrode 1031 and the drain electrode 1033 of the thin film transistor 103, a resistance-capacitance (RC) delay circuit is generated in the pixel region. The RC delay circuit is liable to distort the scanning signals applied to the gate lines 101. The degree of distortion is determined by the resistance R of the gate lines 101 and the parasitic capacitance $C_{gd}$.

FIG. 9 shows a waveform diagram of two driving voltages respectively applied to two pixel regions coupled to the same gate line 101, wherein one of the pixel regions is nearest to the corresponding gate driving circuit 110, and the other pixel region is farthest from the same corresponding gate driving circuit 110. $V_{off}$ represents a shutting off voltage of the thin film transistors 103 in the two pixel regions, $V_{g1}$ and $V_{g2}$ respectively represent scanning signals applied to the pixel regions nearest to and farthest from the gate driving circuit 110, and $V_{d1}$ and $V_{d2}$ respectively represent data voltage signals applied to the pixel regions nearest to and farthest from the gate driving circuit 110.

The date voltage signals $V_{d1}$ and $V_{d2}$ are reversed at time t0. That is, at the time t0, the thin film transistors 103 in the pixel regions of the first row should be shut off, and the thin film transistors 103 in the pixel regions of the second row should be opened. However, the thin film transistors 103 generate distortion due to the scanning signals $V_{g1}$ and $V_{g2}$, and shut off at time t1 and time t2 respectively. Therefore the reversed data signals $V_{d1}$ and $V_{d2}$ are respectively transmitted into the storage capacitors 106 of the pixel regions during a time period from t0 to t1 and a time period from t0 to t2 respectively. This makes the storage capacitors 106 undergo rapid electrical leakages during the periods from t0 to t1 and from t0 to t2 respectively.

In each row of the pixel regions, the storage capacitors 106 that are nearest to the gate driving circuit 110 are liable to undergo rapid electrical leakages during the period from t0 to t1. In each row of the pixel regions, the storage capacitors 106 that are farthest from the gate driving circuit 110 are liable to undergo rapid electrical leakages during the period from t0 to t2.

In general, the period from to t1 is very short, and can be ignored. However, the period from t0 to t2 is relatively long, and significant electrical leakages can occur during this time. This prevents the LCD panel from displaying high quality black images.

Accordingly, what is needed is a driving circuit that can overcome the above-described deficiencies. What is also needed is an LCD panel utilizing such driving circuit.

SUMMARY

A driving circuit includes: a plurality of parallel gate lines; a plurality of parallel data lines orthogonal to the gate lines; a plurality of pixel electrodes; a plurality of thin film transistors, each of the thin film transistors positions near a crossing of a corresponding gate line and a corresponding data line, each of the thin film transistors includes a gate electrode coupled to the corresponding gate line, a source electrode coupled to the corresponding data line, and a drain electrode coupled to a corresponding one of the pixel electrodes; a plurality of gate driving circuits for driving the gate lines; a plurality of data driving circuits for driving the data lines; and a compensative unit having a first input terminal, a second input terminal, and a plurality of output terminals coupled to the data driving circuits, respectively. The first and second input terminals are coupled to two nodes of one of the gate lines, and the two of the nodes are coupled to two gate electrodes of two thin film transistors respectively connected to a selected two of the data driving circuits. The compensative unit outputs a plurality of compensative voltages for compensating data voltage signals outputted by the data driving circuits, according to delays of two scanning signals received from the first and second input terminals, respectively.

A liquid crystal display panel includes a first substrate; a second substrate opposite to the first substrate; a liquid crystal layer interposed between the first and second substrates; and a driving circuit for driving the liquid crystal panel. The driving circuit includes a plurality of gate lines; a plurality of data lines orthogonal and isolative to the gate lines; a plurality of pixel electrodes; a plurality of thin film transistors, each of the thin film transistors positions near a crossing of a corresponding gate line and a corresponding data line, each of the thin film transistors includes a gate electrode coupled to the corresponding gate line, a source electrode coupled to the corresponding data line, and a drain electrode coupled to one of the corresponding pixel electrodes; a plurality of gate driving circuits for driving the gate lines; a plurality of data driving circuits for driving the data lines; and a compensative unit having a first input terminal, a second input terminal, and a plurality of output terminals coupled to the data driving circuits, respectively. The first and second input terminals are coupled to two nodes of one of the gate lines, and the two nodes are coupled to two gate electrodes of two of the thin film transistors respectively connected to a selected two of the data driving circuits. The compensative unit outputs a plurality of compensative voltages for compensating data voltage signals outputted by the data driving circuits, according to delays of two scanning signals received from the first and second input terminals, respectively.

Other novel features and advantages will become apparent from the following detailed description of preferred and exemplary embodiments when taken in conjunction with the accompanying drawings. In the drawings, all the views are schematic.

DETAILED DESCRIPTION OF PREFERRED EMBODIMENTS

Reference will now be made to the drawings to describe preferred and exemplary embodiments of the present invention in detail.

Figure 1:
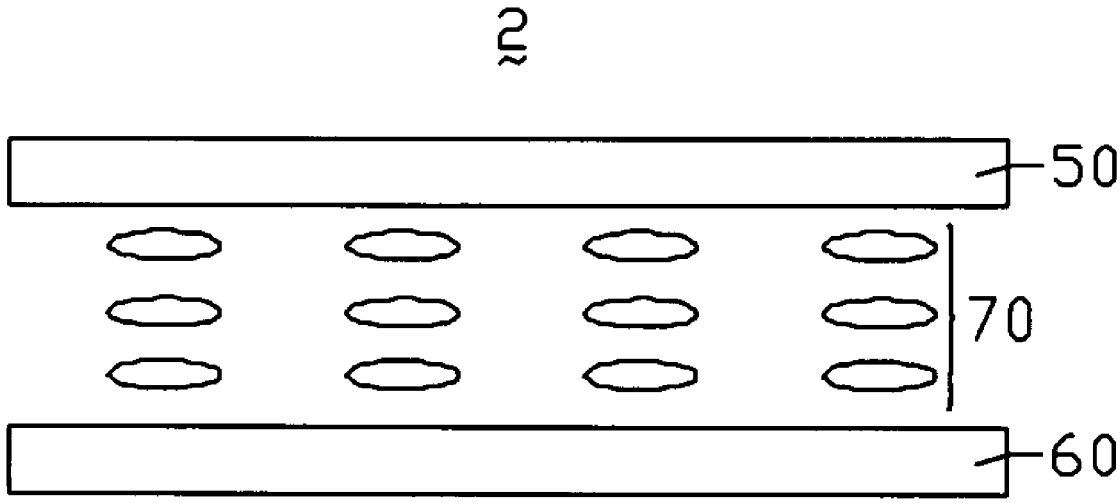
FIG. 1 is an isometric, side view of an LCD panel according to an exemplary embodiment of the present invention.

Referring to FIG. 1, this is a side view of an LCD panel according to an exemplary embodiment of the present invention. The LCD panel 2 includes a first substrate 50, a second substrate 60 parallel to and spaced apart from the first substrate 50, a liquid crystal layer 70 interposed between the first and second substrates 50, 60. The LCD panel 2 is driven by a driving circuit.

Figure 2:
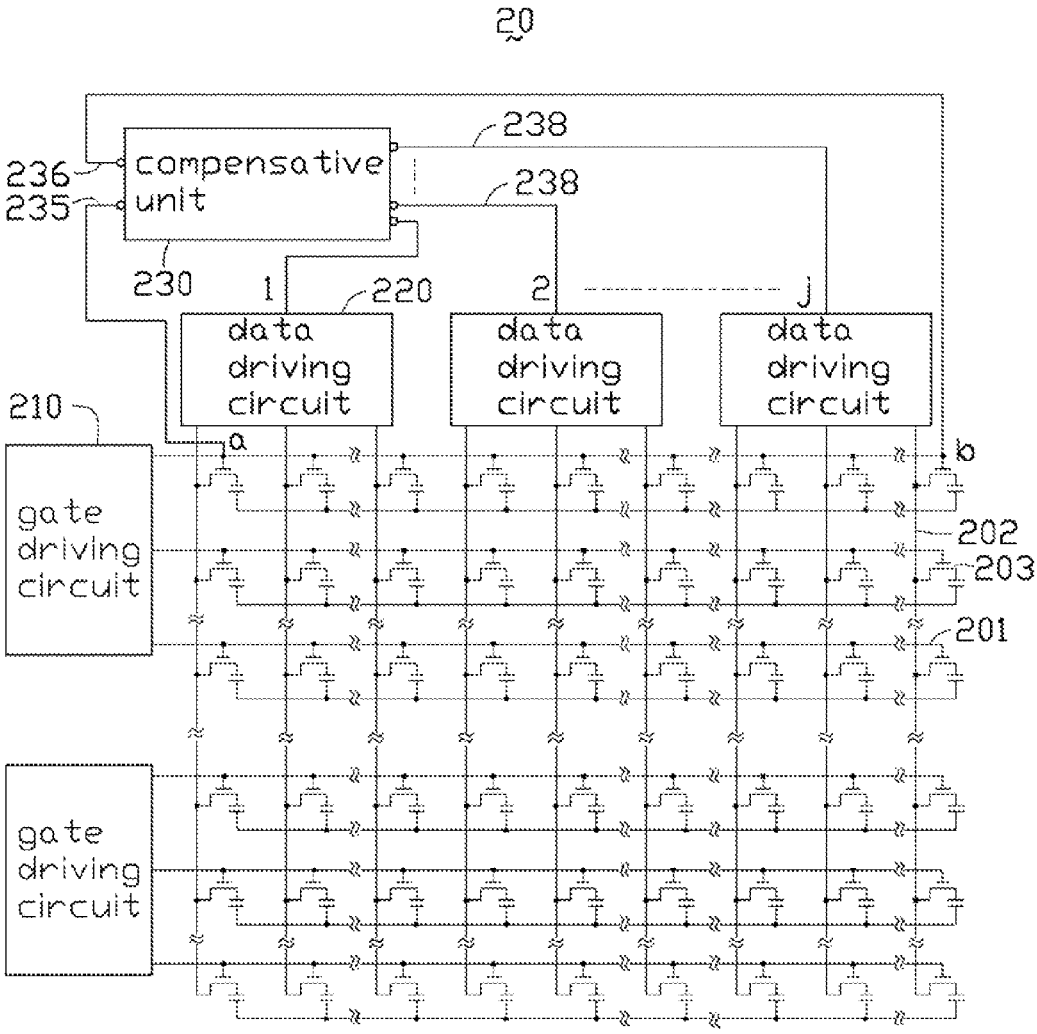
FIG. 2 is an abbreviated diagram of a first embodiment of a driving circuit of the present invention, the driving circuit configured to be installed in the LCD panel of FIG. 1.

Referring to FIG. 2, an abbreviated diagram of a first embodiment of a driving circuit according to the present invention is shown. The driving circuit 20 is configured to be installed in the LCD panel 2. The driving circuit 20 includes a plurality of parallel gate lines 201, a plurality of parallel data lines 202 orthogonal to and isolated from the gate lines 201, a plurality of thin film transistors 203 positioned near crossings of corresponding gate lines 201 and corresponding data lines 202, a plurality of gate driving circuits 210 for driving the gate lines 201, a plurality of data driving circuits 220 for driving the data lines 202, and a compensative unit 230.

Figure 3:
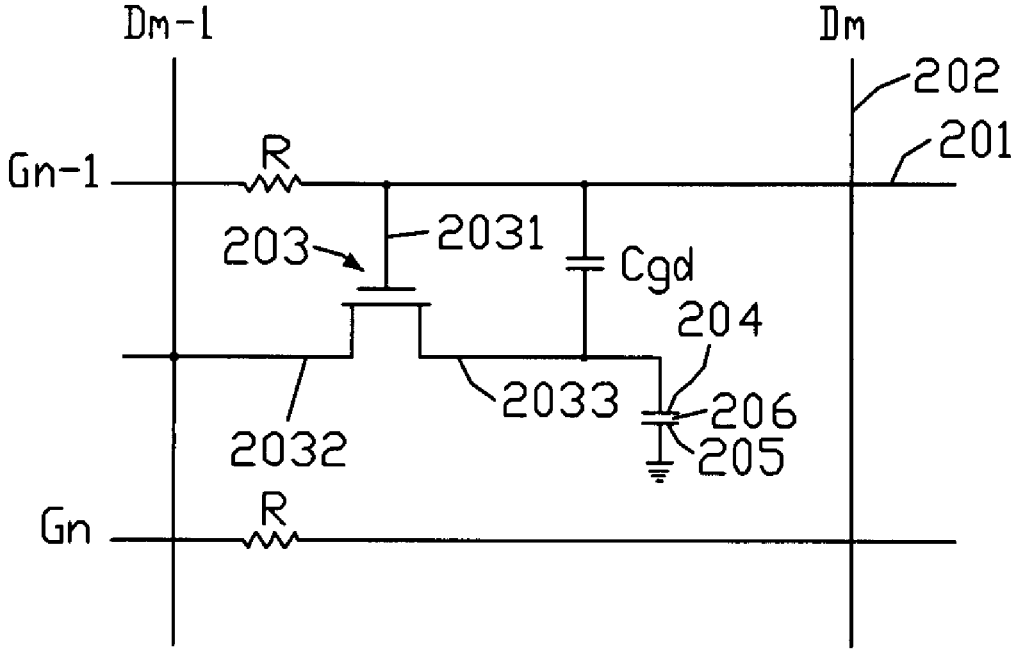
FIG. 3 is a circuit diagram of a pixel region of the driving circuit of FIG. 2.

Also referring to FIG. 3, two adjacent gate lines 201 (Gn, Gn-1) and two adjacent data lines 202 (Dm-1, Dm) cooperatively define a pixel region (not labeled). In each pixel region, the driving circuit 20 further includes a pixel electrode 204 and a common electrode 205. The pixel electrode 204 and the common electrode 205 cooperatively form a storage capacitor 206. The thin film transistor 203 includes a gate electrode 2031 connected to a corresponding gate line Gn-1, a source electrode 2032 connected to a corresponding data line Dm-1, and a drain electrode 1033 connected to the pixel electrode 204.

The compensative unit 230 includes a first input terminal 235, a second input terminal 236, and a plurality of output terminals 238. The first input terminal 235 is coupled to a node "a" of a first one of the gate lines 201. The node "a" in turn is coupled to a gate electrode 2031 of the corresponding thin film transistor 203 that is nearest to the corresponding gate driving circuit 210. The second input terminal 236 is coupled to a node "b" of the same first gate line 201. The node "b" in turn is coupled to a gate electrode 2031 of the corresponding thin film transistor 203 that is farthest from the same corresponding gate driving circuit 210. The output terminals 238 are coupled to the data driving circuits 220, respectively. The compensative circuit 230 can calculate a difference between the reversed data voltage signals transmitted to the storage capacitors 206 corresponding to the nodes "a" and "b", and then output a plurality of compensative voltages to the data driving circuits 220 for compensating data voltage signals outputted by the data driving circuits 220.

Figure 4:
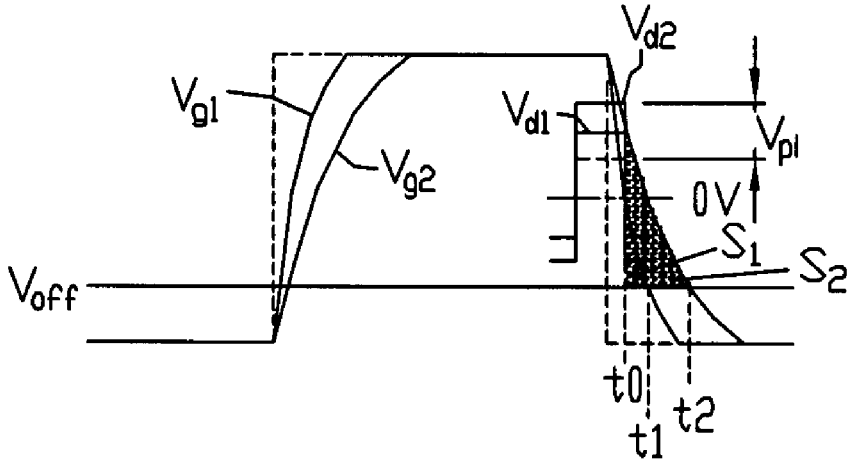
FIG. 4 is a waveform diagram of two driving voltages respectively applied to two pixel regions coupled to a same gate line of the driving circuit of FIG. 2.

Referring to FIG. 4, this shows a waveform diagram of two driving voltages respectively applied to two pixel regions coupled to a same gate line 201 of the driving circuit 20, wherein one of the pixel regions is nearest to the corresponding gate driving circuit 110, and the other pixel region is farthest from the same corresponding gate driving circuit 110. $V_{off}$ represents a shutting off voltage of the thin film transistors 203 in the two pixel regions, $V_{g1}$ and $V_{g2}$ respectively represent scanning signals applied to the pixel regions nearest to and farthest from the gate driving circuit 210, and $V_{d1}$ and $V_{d2}$ respectively represent data voltage signals applied to the pixel regions nearest to and farthest from the gate driving circuit 210.

As shown in FIG. 4, a compensative voltage $V_{pj}$ for compensating the data voltage signal $V_{d2}$ can be expressed by the following equation (1):

$$V_{pj}=(j-1)V_s \tag{1}$$

where j represents the number of data driving circuits 220, and $V_s$ represents a unit compensative voltage. $V_s$ can be expressed by the following equation (2):

$$V_s = \frac{K\left(\int_{t0}^{t2} V_b\,dt - \int_{t0}^{t1} V_a\,dt\right)}{j} \tag{2}$$

where K represents an adjusting constant, t0 represents a time of reversing of the data voltage signals $V_{d1}$ and $V_{d2}$, t1 represents a time of shutting off of the thin film transistor 203 of the pixel region nearest to the corresponding gate driving circuit 210, t2 represents a time of shutting off of the thin film transistor 203 of the pixel region farthest from the same corresponding gate driving circuit 210, $V_a$ represents an instant voltage of the node "a" during a time period from t0 to t1, and $V_b$ represents an instant voltage of the node "b" during a time period from to t2.

The formula (2) can be explained as follows:

$$\int_{t0}^{t2} V_b\,dt - \int_{t0}^{t1} V_a\,dt$$

represents a difference between an area S1 and an area S2 in FIG. 4. The difference in areas represents the delay difference between the scanning signals applied to the pixel region nearest to the gate driving circuits 210 and the scanning signals applied to the pixel region farthest from the gate driving circuits 210.

Taking each of the data driving circuits 220 as a unit, and assuming that the delays of the scanning signals applied to each of the pixel regions coupled to the same data driving circuit unit are approximately the same, then the delay in each data driving circuit unit can be taken as having a single value. Then, $$\frac{\left(\int_{t0}^{t2} V_b\,dt - \int_{t0}^{t1} V_a\,dt\right)}{j}$$

can approximately represent a delay difference between the scanning signals applied to each of the pixel regions coupled to the (i+1)th data driving circuit 220 and the scanning signals applied to each of the pixel regions coupled to the ith data driving circuit 220.

$$\frac{K\left(\int_{t0}^{t2} V_b\,dt - \int_{t0}^{t1} V_a\,dt\right)}{j}$$

represents an adjustment of the above delay difference with the adjusting constant K, and this modified formula represents an area difference of the reversing data voltage signals transmitted to each of the pixel regions coupled to the (i+1)th data driving circuit 220 and the reversing data voltage signals applied to each of the pixel regions coupled to the ith data driving circuit 220.

The area difference of the reversing data voltage signals transmitted to each of the pixel regions coupled to the (i+1)th and ith data driving circuits 220 is equal to an electrical leakage difference between each of the pixel regions coupled to the (i+1)th and ith data driving circuits 220. This area difference is also equal to the compensative voltage difference needed to be transmitted to each of the pixel regions coupled to the (i+1)th and ith data driving circuits 220. That is, $$\frac{K\left(\int_{t0}^{t2} V_b\,dt - \int_{t0}^{t1} V_a\,dt\right)}{j}$$

represents a unit compensative voltage.

The compensative unit 230 of the driving circuit 20 may output a compensative voltage $V_{pi}$ to each of the data driving circuits 220 via the output terminal 238 coupled to the data driving circuit 220 one by one, and the compensative voltage $V_{pi}$ may be expressed by the following equation (3):

$$V_{pi}=(i-1)V_s,\ (i=1, 2, 3 \ldots j) \tag{3}$$

where i represents the ith data driving circuit 220.

With this configuration, the compensative unit 230 can output compensative voltages $V_{pi}$ to the data driving circuits 220 according to the delay of the scanning signals applied to the first and second input terminals 235 and 236, for compensating the data voltage signals outputted by the data driving circuits 220. Therefore, the data voltage signals influenced by the electrical leakages of the storage capacitors 206 are compensated, which helps ensure that the LCD panel 2 can provide a high display performance.

Figure 5:
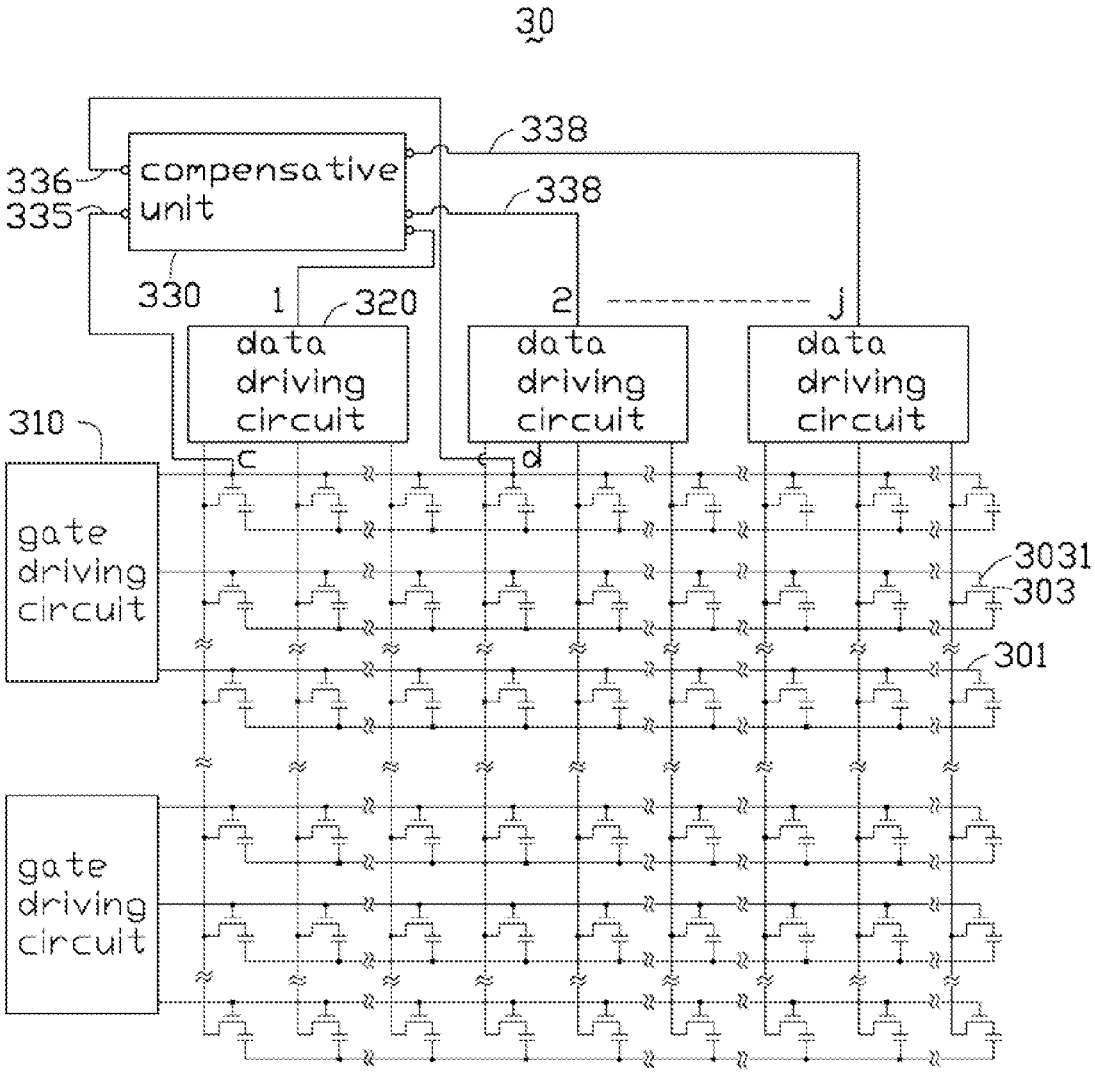
FIG. 5 is an abbreviated diagram of a second embodiment of a driving circuit of the present invention, the driving circuit configured to be installed in the LCD panel of FIG. 1.

Referring to FIG. 5, an abbreviated diagram of a second embodiment of a driving circuit according to the present invention is shown. The driving circuit 30 is configured to be installed in the LCD panel 2. The driving circuit 30 is similar to the driving circuit 20. However, the driving circuit 30 includes a compensative unit 330 having a first input terminal 335, a second input terminal 336, and a plurality of output terminals 338. The first input terminal 335 is coupled to a node "c" of a first one of the gate lines 301. The node "c" in turn is coupled to a gate electrode 3031 of a thin film transistor 303 that is nearest to the corresponding gate driving circuit 310, which thin film transistor 303 is coupled to a first one of the data driving circuits 320. The thin film transistor 303 coupled to the node "c" is nearest to the gate driving circuit 310 compared with other thin film transistors 303 that are coupled to the first data driving circuit 320. The second input terminal 336 is coupled to a node "d" of the same first gate line 301. The node "d" in turn is coupled to a gate electrode 3031 of a thin film transistor 303, which thin film transistor 303 is coupled to a second one of the data driving circuits 320 that is next to the first data driving circuit 320. The thin film transistor 303 coupled to the node "d" is nearest to the gate driving circuit 310 compared with other thin film transistors 303 that are coupled to the second data driving circuit 320. The output terminals 338 are coupled to the data driving circuits 320, respectively.

The compensative unit 330 of the driving circuit 30 may output a compensative voltage $V_{pi}'$ to each of the data driving circuits 320 via the output terminal 338 coupled to the data driving circuit 320 one by one, and the compensative voltage $V_{pi}'$ may be expressed by the following equation (4):

$$V_{pi}'=(i-1)V_s',\ (i=1, 2, 3 \ldots j) \tag{4}$$

where i represents the ith data driving circuit 320, j represents the number of data driving circuits 320, and $V_s'$ represents a unit compensative voltage. The unit compensative voltage can be expressed by the following equation (5):

$$V_s' = K'\left(\int_{t0'}^{t2'} V_d\,dt - \int_{t0'}^{t1'} V_c\,dt\right) \tag{5}$$

where K' represents an adjusting constant, t0' represents a time of reversing of data voltage signals transmitted to the pixel regions coupled to the nodes "c" and "d", t1' represents a time of shutting off of the thin film transistor 303 coupled to the node "c" of the gate line 301, t2' represents a time of shutting off of the thin film transistor 303 coupled to the node "d" of the gate line 301, $V_c$ represents an instant voltage of the node "c" in a time period from t0' to t1', and $V_d$ represents an instant voltage of the node "d" in a time period from t0' to t2'.

Figure 6:
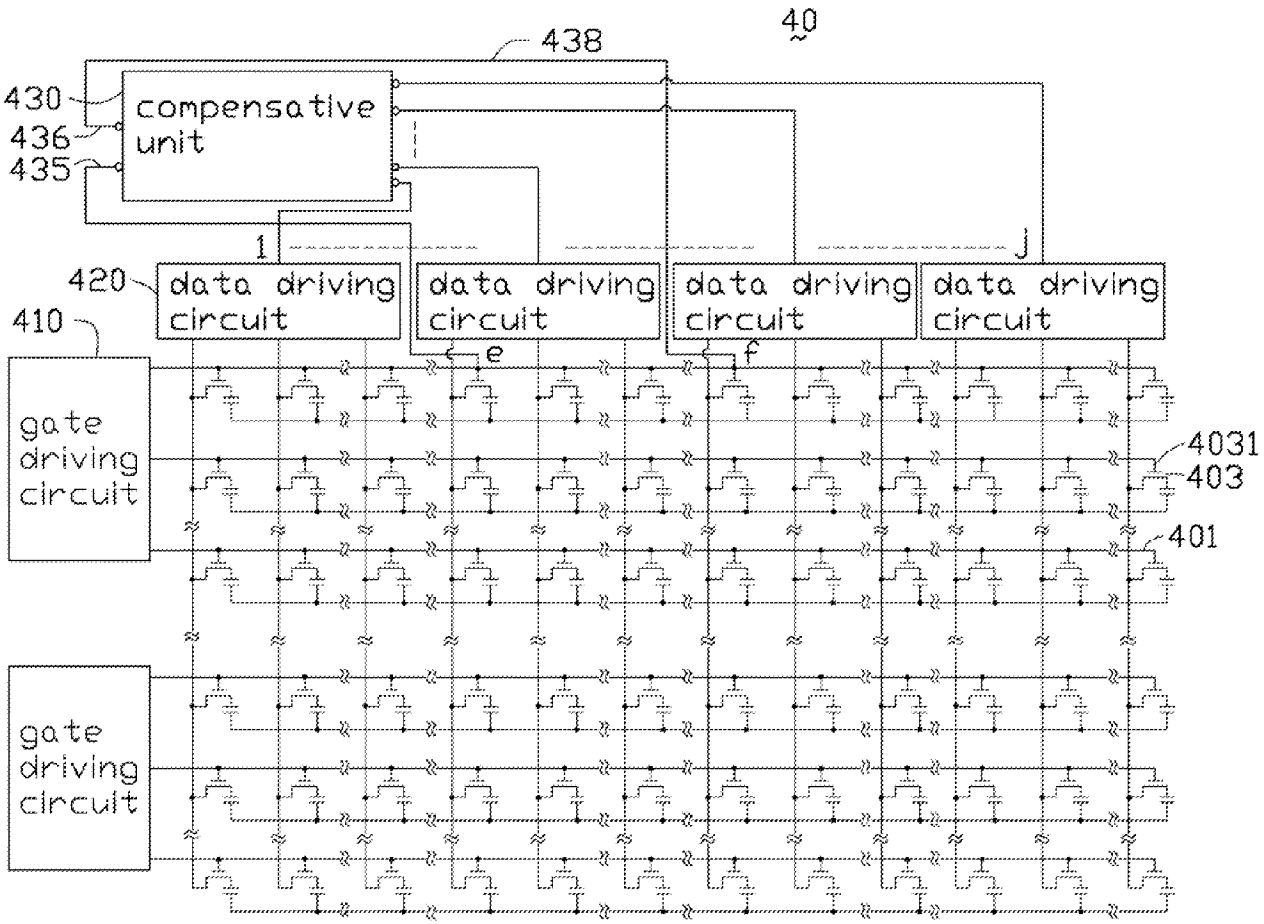
FIG. 6 is an abbreviated diagram of a third embodiment of a driving circuit of the present invention, the driving circuit configured to be installed in the LCD panel of FIG. 1.
Figure 7:
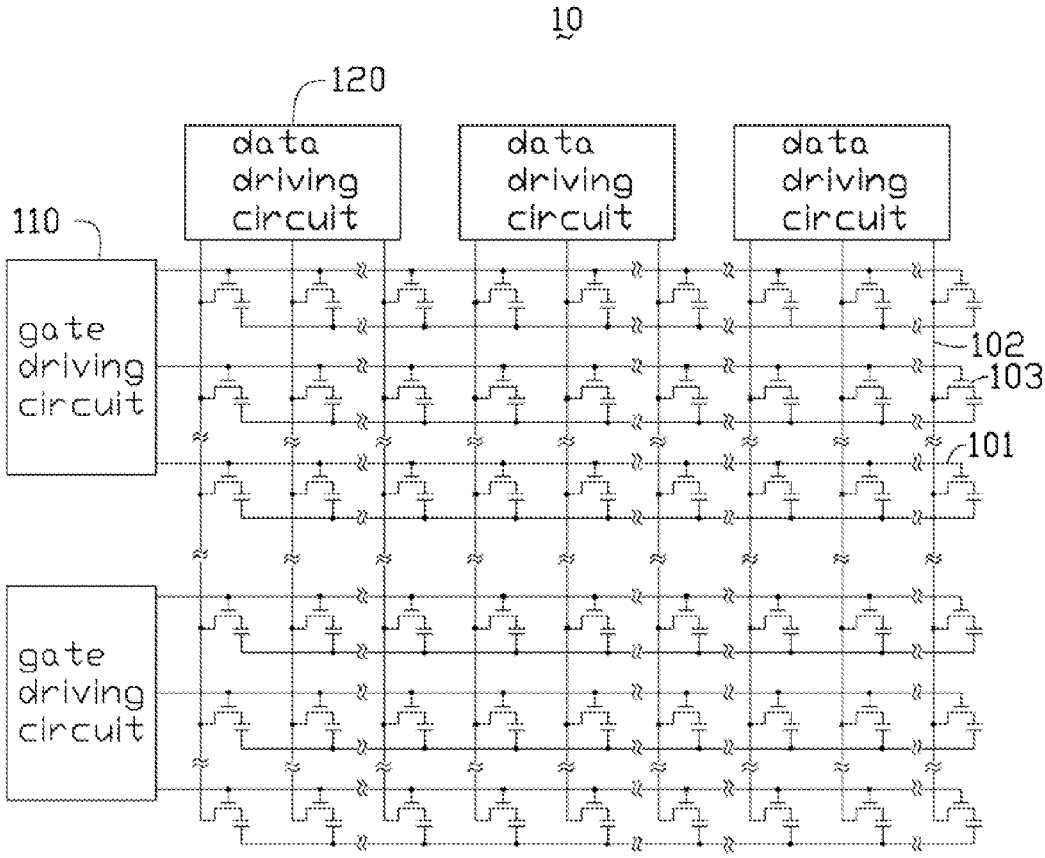
FIG. 7 (RELATED ART)
FIG. 7 is an abbreviated diagram of a conventional driving circuit for an LCD panel.
Figure 8:
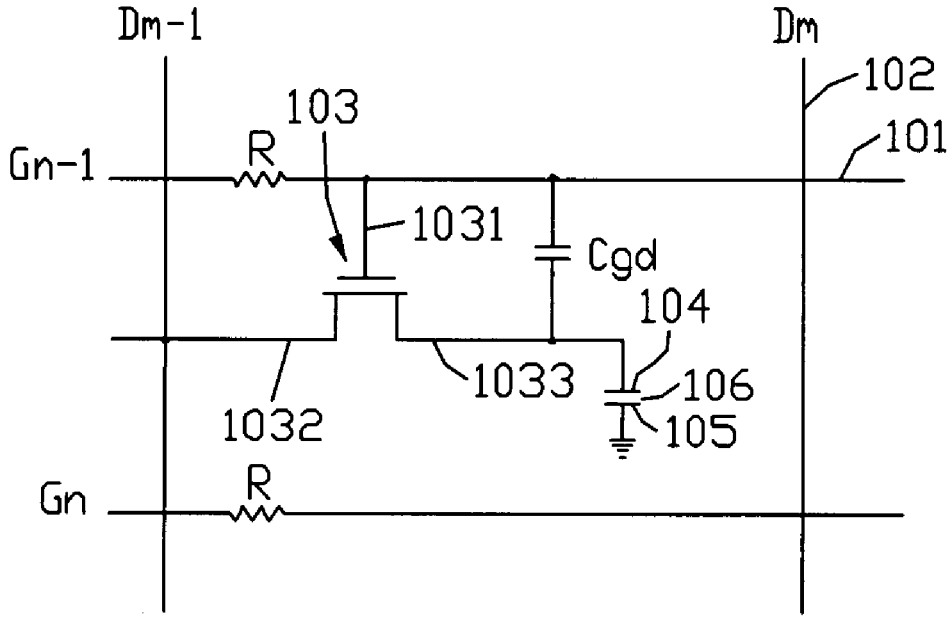
FIG. 8 (RELATED ART)
FIG. 8 is a circuit diagram of a pixel region of the driving circuit of FIG. 7.
Figure 9:
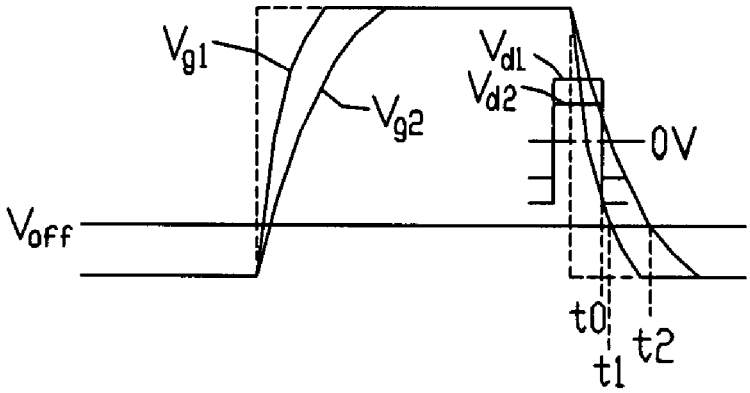
FIG. 9 (RELATED ART)
FIG. 9 is a waveform diagram of two driving voltages respectively applied to two pixel regions coupled to a same gate line of the driving circuit of FIG. 7.

Referring to FIG. 6, an abbreviated diagram of a third embodiment of a driving circuit according the present invention is shown. The driving circuit 30 is configured to be installed in the LCD panel 2. The driving circuit 40 is similar to the driving circuit 30. However, the driving circuit 40 includes a compensative unit 430 having a first input terminal 435, a second input terminal 436, and a plurality of output terminals 438. The first and second input terminals 435 and 436 are coupled to gate electrodes 4031 of two thin film transistors 403 connected to two selected different data driving circuits 420. Which two of the data driving circuits 420 are selected can be determined according to individual manufacturer and/or user requirements or individual manufacturer and/or user preference. The output terminals 438 are coupled to the data driving circuits 420, respectively.

The compensative unit 430 of the driving circuit 40 may output a compensative voltage $V_{pi}''$ to each of the data driving circuits 420 via the output terminal 438 coupled to the data driving circuit 420 one by one, and the compensative voltage $V_{pi}''$ may be expressed by the following equation (6):

$$V_{pi}''=(i-1)V_s'',\ (i=1, 2, 3 \ldots j) \tag{6}$$

where i represents the ith data driving circuit 420, j represents the number of data driving circuits 420, and $V_s''$ represents a unit compensative voltage. The unit compensative voltage can be expressed by the following equation (7):

$$V_s'' = \frac{K''\left(\int_{t0''}^{t2''} V_f\,dt - \int_{t0''}^{t1''} V_e\,dt\right)}{K_2 - K_1}, \tag{7}$$

$$(K_1 = 1, 2, 3 \ldots j-1,\ K_2 = 2, 3 \ldots j,\ K_2 > K_1),$$

where K" represents an adjusting constant, t0" represents a time of reversing of data voltage signals transmitted to the pixel regions coupled to the nodes "e" and "f", t1" represents a time of shutting off the thin film transistor 403 coupled to the node "e" of the gate line 401, t2" represents a time of shutting off of the thin film transistor 403 coupled to the node "f" of the gate line 401, $V_e$ represents an instant voltage of the node "e" in a time period from t0" to t1", $V_f$ represents an instant voltage of the node "f in a time period from t0" to t2", and $K_1$ represents the number of data driving circuit 420 corresponding to the node "e", and $K_2$ represents the number of data driving circuit 420 corresponding to the node "f".

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A driving circuit comprising:

a plurality of parallel gate lines;

a plurality of parallel data lines orthogonal to the gate lines;

a plurality of pixel electrodes;

a plurality of thin film transistors, each of the thin film transistors positioned near a crossing of a corresponding gate line and a corresponding data line, each of the thin film transistors comprising a gate electrode coupled to the corresponding gate line, a source electrode coupled to the corresponding data line, and a drain electrode coupled to a corresponding one of the pixel electrodes;

a plurality of gate driving circuits for driving the gate lines;

a plurality of data driving circuits for driving the data lines; and a compensative unit having a first input terminal, a second input terminal, and a plurality of output terminals coupled to the data driving circuits, respectively;

wherein the first and second input terminals are coupled to two nodes of one of the gate lines, the two nodes are coupled to two gate electrodes of two of the thin film transistors respectively connected to a selected two of the data driving circuits, and the compensative unit outputs a plurality of compensative voltages for compensating data voltage signals outputted by the data driving circuits, according to delays of two scanning signals received from the first and second input terminals, respectively, wherein the two nodes are a node "1" and a node "2", and the compensative voltage is expressed by the following equation:

$$V_{pi}=(i-1)V_s,\ (i=1, 2, 3 \ldots j),$$

where $V_{pi}$ represents a compensative voltage transmitted to an ith data driving circuit, j represents a number of data driving circuits, $V_s$ represents a unit compensative voltage, which is expressed by the equation:

$$V_s'' = \frac{K''\left(\int_{t0''}^{t2''} V_2\,dt - \int_{t0''}^{t1''} V_1\,dt\right)}{K_2 - K_1},$$

$$(K_1 = 1, 2, 3 \ldots j-1,\ K_2 = 2, 3 \ldots j,\ K_2 > K_1),$$

where t0 represents a time of reversing of data voltage signals transmitted to the two thin film transistors with gate electrodes coupled to the nodes "1" and "2" respectively, t1 represents a time of shutting off of the thin film transistor with the gate electrode coupled to the node "1", t2 represents a time of shutting off of the thin film transistor with the gate electrode coupled to the node "2", $V_1$ represents an instant voltage of the node "1" during a time period from t0 to t1, $V_2$ represents an instant voltage of the node "2" during a time period from t0 to t2, K represents an adjusting constant, $K_1$ represents a number of data driving circuits corresponding to the node "1", and $K_2$ represents a number of data driving circuit corresponding to the node "2".

2. The driving circuit as claimed in claim 1, wherein the first input terminal is coupled to a gate electrode of a the thin film transistor that is nearest to the gate driving circuits, which is coupled to a corresponding data driving circuit; and the second input terminal is coupled to a gate electrode of another thin film transistor that is farthest to the gate driving circuits, which is coupled to another corresponding data driving circuit.

3. The driving circuit as claimed in claim l, further comprising a plurality of common electrodes, the pixel electrode and the common electrodes cooperatively forming a plurality of storage capacitors.

4. The driving circuit as claimed in claim 1, wherein the first input terminal is coupled to a gate electrode of a thin film transistor that is nearest to the gate driving circuits, the thin film transistor is coupled to a first data driving circuit; and the second input terminal is coupled to a gate electrode of a thin film transistor coupled to a second data driving circuit next to the first data driving circuit, the thin film transistor is nearest to the gate driving circuits compared with other thin film transistors coupled to the second data driving circuit.

5. A liquid crystal display panel, comprising:

a first substrate;

a second substrate opposite to the first substrate;

a liquid crystal layer interposed between the first and second substrates; and a driving circuit for driving the liquid crystal panel, the driving circuit comprising:

a plurality of gate lines;

a plurality of data lines orthogonal and isolative to the gate lines;

a plurality of pixel electrodes;

a plurality of thin film transistors, each of the thin film transistors positioned near a crossing of a corresponding gate line and a corresponding data line, each of the thin film transistors comprising a gate electrode coupled to the corresponding gate line, a source electrode coupled to the corresponding data line, and a drain electrode coupled to a corresponding one of the pixel electrodes;

a plurality of gate driving circuits for driving the gate lines;

a plurality of data driving circuits for driving the data lines; and a compensative unit having a first input terminal, a second input terminal, and a plurality of output terminals coupled to the data driving circuits, respectively;

wherein the first and second input terminals are coupled to two nodes of one of the gate lines, the two nodes are coupled to two gate electrodes of two of the thin film transistors respectively connected to a selected two of the data driving circuits, and the compensative unit outputs a plurality of compensative voltages for compensating data voltage signals outputted by the data driving circuits, according to delays of two scanning signals received from the first and second input terminals, respectively, wherein the two nodes are a node "1" and a node "2", and the compensative voltage is expressed by the following equation:

$$V_{pi}=(i31\ 1)V_s,\ (i=1, 2, 3 \ldots j),$$

where $V_{pi}$ represents a compensative voltage transmitted to an ith data driving circuit, j represents a number of data driving circuits, $V_s$ represents a unit compensative voltage, which is expressed by the equation:

$$V_s'' = \frac{K''\left(\int_{t0''}^{t2''} V_2\,dt - \int_{t0''}^{t1''} V_1\,dt\right)}{K_2 - K_1},$$

$$(K_1 = 1, 2, 3 \ldots j-1,\ K_2 = 2, 3 \ldots j,\ K_2 > K_1),$$

where t0 represents a time of reversing of data voltage signals transmitted to the two thin film transistors with gate electrodes coupled to the nodes "1" and "2" respectively, t1 represents a time of shutting off of the thin film transistor with the gate electrode coupled to the node "1", t2 represents a time of shutting off of the thin film transistor with the gate electrode coupled to the node "2", $V_1$ represents an instant voltage of the node "1" during a time period from t0 to t1, $V_2$ represents an instant voltage of the node "2" during a time period from t0 to t2, K represents an adjusting constant, $K_1$ represents a number of data driving circuits corresponding to the node "1", and $K_2$ represents a number of data driving circuit corresponding to the node "2".

6. The liquid crystal display panel as claimed in claim 5, wherein the first input terminal is coupled to a gate electrode of a the thin film transistor that is nearest to the gate driving circuits, which is coupled to a corresponding data driving circuit; and the second input terminal is coupled to a gate electrode of another thin film transistor that is farthest to the gate driving circuits, which is coupled to another corresponding data driving circuit.

7. The liquid crystal display panel as claimed in claim 5, further comprising a plurality of common electrodes, the pixel electrode and the common electrodes cooperatively forming a plurality of storage capacitors.

8. The liquid crystal display panel as claimed in claim 5, wherein the first input terminal is coupled to a gate electrode of a thin film transistor that is nearest to the gate driving circuits, the thin film transistor is coupled to a first data driving circuit; and the second input terminal is coupled to a gate electrode of a thin film transistor coupled to a second data driving circuit next to the first data driving circuit, the thin film transistor is nearest to the gate driving circuits compared with other thin film transistors coupled to the second data driving circuit.

9. A method of making a driving circuit comprising steps of:

providing a plurality of parallel gate lines;

providing a plurality of parallel data lines orthogonal to the gate lines;

providing a plurality of pixel electrodes; . providing a plurality of thin film transistors, each of the thin film transistors positioned near a crossing of a corresponding gate line and a corresponding data line, each of the thin film transistors comprising a gate electrode coupled to the corresponding gate line, a source electrode coupled to the corresponding data line, and a drain electrode coupled to a corresponding one of the pixel electrodes;

providing a plurality of gate driving circuits for driving the gate lines; providing ga plurality of data driving circuits for driving the data lines; and providing a compensative unit having a first input terminal, a second input terminal, and a plurality of output terminals coupled to the data driving circuits, respectively;

wherein the first and second input terminals are coupled to two nodes of one of the gate lines, the two nodes are coupled to two gate electrodes of two of the thin film transistors respectively connected to selected two of the data driving circuits, and the compensative unit outputs a plurality of compensative voltages for compensating data voltage signals outputted by the data driving circuits, according to delays of two scanning signals received from the first and second input terminals, respectively, wherein the two nodes are a node "1" and a node "2", and the compensative voltage is expressed by the following equation:

$$V_{pi}=(i31\ 1)V_s,\ (i=1, 2, 3 \ldots j),$$

where $V_{pi}$ represents a compensative voltage transmitted to an ith data driving circuit, j represents a number of data driving circuits, $V_s$ represents a unit compensative voltage, which is expressed by the equation:

$$V_s'' = \frac{K''\left(\int_{t0''}^{t2''} V_2\,dt - \int_{t0''}^{t1''} V_1\,dt\right)}{K_2 - K_1},$$

$$(K_1 = 1, 2, 3 \ldots j-1,\ K_2 = 2, 3 \ldots j,\ K_2 > K_1),$$

where t0 represents a time of reversing of data voltage signals transmitted to the two thin film transistors with gate electrodes coupled to the nodes "1" and "2" respectively, t1 represents a time of shutting of of the thin film transistor with the gate electrode coupled to the node "1", t2 represents a time of shutting off of the thin film transistor with the gate electrode coupled to the node "2", $V_1$ represents an instant voltage of the node "1" during a time period from t0 to t1, $V_2$ represents an instant voltage of the node "2" during a time period from t0 to t2, K represents an adjusting constant, $K_1$ represents a number of data driving circuits corresponding to the node "1", and $K_2$ represents a number of data driving circuit corresponding to the node "2".

10. The method as claimed in claim 9, wherein the first input terminal is coupled to a gate electrode of a the thin film transistor that is nearest to the gate driving circuits, which is coupled to a corresponding data driving circuit; and the second input terminal is coupled to a gate electrode of another thin film transistor that is farthest to the gate driving circuits, which is coupled to another corresponding data driving circuit.

11. The method as claimed in claim 9, wherein the first input terminal is coupled to a gate electrode of a thin film transistor that is nearest to the gate driving circuits, the thin film transistor is coupled to a first data driving circuit; and the second input terminal is coupled to a gate electrode of a thin film transistor coupled to a second data driving circuit next to the first data driving circuit, the thin film transistor is nearest to the gate driving circuits compared with other thin film transistors coupled to the second data driving circuit.

* * * * *